US006652305B1

(12) United States Patent
DiFusco

(10) Patent No.: US 6,652,305 B1
(45) Date of Patent: Nov. 25, 2003

(54) SOCKET TO ACCOMMODATE STANDARD SCREW BASED LIGHT BULB

(76) Inventor: Frank DiFusco, 86 Wimmer Rd., Hopewell Junction, NY (US) 12533

( * ) Notice: Subject to any disclaimer, the term of this patent is extended or adjusted under 35 U.S.C. 154(b) by 0 days.

(21) Appl. No.: 10/331,254

(22) Filed: Dec. 30, 2002

(51) Int. Cl.[7] ..... H01R 4/38
(52) U.S. Cl. ..... 439/255; 439/263
(58) Field of Search ..... 439/253–263, 439/343–348, 236, 243, 244, 356, 319

(56) References Cited

U.S. PATENT DOCUMENTS

| | | | | | |
|---|---|---|---|---|---|
| 3,895,195 | A | * | 7/1975 | Morrison et al. | 200/51.09 |
| 3,915,536 | A | * | 10/1975 | Glantz | 439/188 |
| 3,936,122 | A | * | 2/1976 | Hagelberg | 439/138 |
| 4,222,623 | A | * | 9/1980 | Hultberg | 439/188 |
| 4,279,458 | A | * | 7/1981 | Knapp | 430/255 |
| 4,319,796 | A | | 3/1982 | Wiley | |
| 4,548,449 | A | * | 10/1985 | Corsetti | 439/641 |
| 4,768,966 | A | * | 9/1988 | Doherty | 439/137 |
| 4,778,409 | A | | 10/1988 | Maddock | |
| 4,825,393 | A | | 4/1989 | Armbruster | |
| 4,883,434 | A | | 11/1989 | Toyoshima | |
| 5,030,124 | A | * | 7/1991 | Lorentzon | 439/188 |
| 5,154,628 | A | | 10/1992 | Skegin | |
| 5,278,741 | A | | 1/1994 | Ehrman | |
| 5,380,214 | A | * | 1/1995 | Ortega, Jr. | 439/253 |
| 5,456,611 | A | * | 10/1995 | Henry et al. | 439/180 |
| 5,595,513 | A | | 1/1997 | Kondo | |
| 5,743,758 | A | * | 4/1998 | Cheng et al. | 439/419 |
| 5,800,212 | A | | 9/1998 | Hsu | |
| 5,989,070 | A | | 11/1999 | Al-Turki | |
| 6,322,380 | B1 | * | 11/2001 | Conroy | 439/188 |
| 6,491,534 | B1 | * | 12/2002 | Bonard et al. | 439/188 |

* cited by examiner

*Primary Examiner*—Tho D. Ta
*Assistant Examiner*—Larisa Z Tsukerman
(74) *Attorney, Agent, or Firm*—Michael I. Kroll

(57) ABSTRACT

An electric socket for a standard light bulb has an inner housing movable within an outer housing such that the light bulb threaded base is directly insertable and removable from the inner housing without rotation. The light bulb is held within the inner housing by arcuate contact members that are squeezed against the light bulb threaded base as the threaded base is inserted.

5 Claims, 6 Drawing Sheets

SOCKET TO ACCOMMODATE STANDARD SCREW BASED LIGHT BULB

BACKGROUND OF THE INVENTION

1. Field of the Invention

The present invention relates generally to light sockets that will accept standard screw based light bulbs and more specifically to a push-in socket which may be utilized for facilitating rapid removal or installation of standard light bulbs.

2. Description of the Prior Art

There are other light sockets designed for installing and removing light bulbs. Typical of these is U.S. Pat. No. 5,380,214 issued to Ortega on Jan. 10, 1995.

Another patent was issued to Ehrman on Jan. 11, 1994 as U.S. Pat. No. 5,278,741. Yet another U.S. Pat. No. 5,154,628 was issued to Skegin on Oct. 13, 1992 and still yet another was issued on Nov. 28, 1989 to Toyoshima as U.S. Pat. No. 4,883,434.

Another patent was issued to Maddock on Oct. 18, 1988 as U.S. Pat. No. 4,778,409. Another patent was issued to Wiley on Mar. 16, 1982 as U.S. Pat. No. 4,319,796. Another patent was issued to Al-Turki on Nov. 23, 1999 as U.S. Pat. No. 5,989,070. Another patent was issued to Hsu on Sep. 1, 1998 as U.S. Pat. No. 5,800,212. Another patent was issued to Kondo on Jan. 21, 1997 as U.S. Pat. No. 5,595,513. Another patent was issued to Armbruster on Apr. 25, 1989 as U.S. Pat. No. 4,824,393.

A push-in light socket adapter for use with a conventional household light bulb socket for facilitating a rapid removal and replacement of a light bulb. The adapter includes a threaded socket body which may be engaged to the household light bulb socket in place of the light bulb. The light bulb may then be inserted directly into the adapter without rotating the bulb. The adapter allows a removal of a burnt-out light bulb by a simple pulling motion which releases the bulb from the socket body. A new bulb may then be easily inserted into the adapter by pushing it into the socket body. The light socket adapter further includes an indicator light operable to indicate both a supply of electrical power to the device and a presence of the light bulb within the socket body.

A light bulb assembly includes a light bulb, a base receiving the light bulb, and a socket receiving the base. The base is formed with a displaceable arm terminating in a locking element. The socket is formed with an opening through a wall having an edge adapted to receive the locking element to lock the base to the socket. The base is releasable from the socket by passing a pointed implement through the opening to displace the finger and thereby to release the locking element.

A bayonet type socket improved for handling heavy currents of Halogen bulbs has a socket shell with one or more rivet shaped electrical contacts carried by an insulating disc supported on a main spring in the shell. Each rivet contact is movable on the disc and is driven by an auxiliary spring against the base of the light bulb to ensure positive electrical contact. A superior ground connection is provided by a separate grounding element fitted on the socket exterior.

A wedge-base lamp and socket assembly includes a wedge-base lamp having a pair of projections formed on opposite sides near the center of a base of the wedge-base lamp; and a socket having a pair of resilient arms which come in engagement with the pair of projections when the wedge-base lamp is mounted within the socket. A single filament type wedge-base lamp has foolproof projections formed on opposite sides at opposite end portions of the base, and a double filament type wedge base socket has abutment portions which come in engagement with the fool-proof projections when the single filament type wedge-base lamp is inserted into the double filament type socket to thereby prevent erroneous coupling therebetween. United States Patent A molded electrical lamp socket includes threaded, insulating portions on the inner wall of the socket to engage the lamp. The side electrode providing electrical contact for the lamp is desirably set deeply within the socket, to reduce the danger of accidental finger contact with an electrically conducting lamp. Where the side electrode is of the edge-on type, the insulating threads center the lamp in the socket and reduce the incidence of shaving and jamming of the lamp. United States Patent A compact lamp unit and associated socket for use in a projection system such as a slide projector, microfilm viewer, and so forth. The lamp unit includes a reflector molded from a plastic material and an electric lamp secured within the reflector. In order to decrease the axial dimension of the reflector and to avoid the use of pin connectors, electrical contacts for the lamp are pressed into recesses formed in the outer surface of the reflector. The reflector includes an opening at its apex through which electrical leads from the lamp extend outwardly of the reflector. The electrical leads are secured to the contacts by being forced into the recesses along with the contacts. This construction technique is fast and simple. The lamp unit also includes a handle to enable a heated lamp unit to be replaced by the user and a guide means to enable the lamp unit to be oriented quickly and accurately upon insertion into the socket. In their preferred forms, the handle and the guide means are identically configured and comprise fins extending outwardly of the convex surface of the reflector, the fins lying on opposite sides of the opening and in the same plane. The socket into which guide means is inserted includes a first upstanding member defining a reference plane against which a portion of the reflector is engaged in use. A second upstanding structure engages another portion of the reflector to securely retain the reflector when it is inserted into the socket. The socket includes a pair of flexible contacts engageable with the contacts carried by the lamp unit, the socket contacts being positioned in a plane substantially parallel with the reference plane. When the lamp unit is inserted into the socket, the socket contacts are flexed sufficiently to make good electrical contact with the contacts carried by the lamp unit. A retention mechanism in the form of a flexible bail may be used to prevent inadvertent displacement of the lamp unit from the socket.

A light bulb-socket adapter for connecting a bayonet type light bulb to an Edison type socket or an Edison type light bulb to a bayonet type socket. The light bulb-socket adapter includes an Edison type connector section made of conductive material and a connection terminal extending therefrom and a bayonet type bulb receiving section and first and second contact terminals positioned within the receiving section for connecting a bayonet type light bulb to an Edison type socket. The light bulb-socket adapter includes a bayonet type connector section and first and second contact terminals extending from the connector section and an Edison type bulb receiving section made of conductive material and a connection terminal extending therefrom for connecting an Edison type light bulb to a bayonet type socket. Each adapter includes a nonconductive barrier layer connected between and electrically isolating said Edison type section and bayonet type section, a first connection wire connecting the conductive material of the Edison type section to the first connection terminal of the bayonet type section and a second connection wire connecting the contact terminal of the Edison type section to the second connection terminal of the bayonet type section. When the adapter is connected between a bulb and socket, the bulb and socket form a complete circuit via the first and second wires respectively.

An improved plug-in type light bulb including a light bulb with a plug unit and an electrical socket for receiving the light bulb. The socket is comprised of two symmetrical halves each of which includes an upper portion and a lower portion. A cover plate with a notch is disposed inside at the upper portion, while a plurality of grooves are formed at the lower portion. A plurality of electrically conductive plates are disposed in the grooves and each of which has an angular contact terminal. The plug unit has two side walls each of which has an integrally formed raised block and two lateral walls against which the corresponding contact terminals of the lead wires rest. The lateral walls are further provided with a respective half round groove across which the contact terminal is disposed. When the light bulb is inserted into the socket, the angular contact terminals of the conductive plates will fit into the insert grooves of the plug unit of the light bulb and cause a part of the respective contact terminals of the lead wires to fit into the same insert grooves to achieve firm electrical contact.

A bulb socket terminal to be accommodated in a socket body of a connector bulb socket. The terminal includes a base, an elastic contact portion adapted to contact a filament or an earth of a bulb on one side of the base, and a connecting portion adapted to be connected to a connector on the other side thereof. The bulb socket terminal is integrally formed intermediate of the elastic contact portion and the connecting portion with a resin flow blocking wail which contacts an insert-molding metal mold to seal an area of the elastic contact portion at the time of insert-molding. Accordingly, the area where the elastic contact portion extends is sealed by the resin flow blocking wall at the time of insert-molding with use of the metal mold to thereby prevent the resin from flowing into this area. Therefore, the spring elasticity of the elastic contact portion will not be restricted.

A socketless light bulb holder in the form of a substantially rigid, plastic bracket including a base affixed to a supporting structure with a generally centrally disposed mounting screw and a pair of terminal screws. The holder also includes a bulb holder portion snugly embracing the base of a light bulb. The terminals on the base of the light bulb are connected to conductor members extending from the terminals on the base of the light bulb to the terminal screws on the base of the holder with the conductor members being soldered to the terminals on the base of the light bulb thereby eliminating the necessity of the light bulb being inserted into and twisted in relation to a light bulb socket in order to mount the light bulb in the socket. In one embodiment of the invention, the holder includes a locking retainer for engagement with one of the bayonet pins which conventionally project radially from the base of the light bulb to mechanically lock the bulb in position. In another embodiment, the holder which snugly engages the base of the light bulb is provided with a slot enabling passage of one of the radially extending pins on the base of the light bulb. The positive soldered connection between the light bulb terminals and the conductor members eliminates points of corrosion which frequently result in the electrical energy supplied to the light bulb becoming interrupted While these light bulb sockets may be suitable for the purposes for which they were designed, they would not be as suitable for the purposes of the present invention, as hereinafter described. It is thus desirable to provide a push-in light socket for use with a conventional light bulb for facilitating an easy removal and replacement of a light bulb.

SUMMARY OF THE PRESENT INVENTION

A primary object of the present invention is to provide a light bulb socket for use with a conventional light bulb.

Another object of the present invention is to provide a light bulb socket that allows for facilitating an easy removal of a light bulb.

Yet another object of the present invention is to provide a light bulb socket that a light bulb may be inserted directly into the socket without rotating the bulb.

Still yet another object of the present invention is to provide a socket that allows an installation of a light bulb by a simple push motion which locks the bulb in position.

Yet another object of the present invention is to provide a socket that allows the removal of a light bulb by a simple pull motion which releases the bulb from the socket.

Additional objects of the present invention will appear as the description proceeds.

The present invention overcomes the shortcomings of the prior art by providing a light bulb socket for use with a conventional light bulb. The socket device of the present invention provides a push-in light socket for use with a conventional light bulb for facilitating an easy removal and replacement of a light bulb. The light bulb may be inserted directly into the socket without rotating the bulb. The socket allows an installation of a light bulb by a simple push motion which releases the bulb from the socket.

To insert the bulb, the user merely pushes the bulb into the socket. The socket will retain the bulb without the conventional screwing of the bulb. To remove the bulb the user merely pulls the bulb straight out.

My invention provides a socket for receiving a light bulb and electrically powering the bulb using power from an electric power source having a positive and a negative, the light bulb having a threaded base as a negative electrical contact, and a tip as positive electrical contact, the socket comprising: an outer housing, an inner housing within the outer housing, and a pair of arcuate contact members within the inner housing, the inner housing being movable from a stationary upper position to a stationary lower position, the arcuate contact members at least partially encompassing and contacting the light bulb threaded base when the threaded base is inserted into the inner housing, at least one of the contact members being in electrical communication with the electric power source negative when the inner housing is in the lower position; a positive contact member in electrical communication with the electrical power source positive, the positive contact member being positioned in the inner housing for contact with the inserted light bulb tip when the inner housing is in the lower position; a retaining member for retaining the inner housing in the lower position, the retaining member releasing the inner housing in response to removal of the threaded base from the inner housing; and a biasing member for biasing the inner housing to the upper position member when the retaining member releases the inner housing from the lower position; and further wherein the outer housing comprises an interior, the interior forming an interior wall, the interior wall having an upwardly facing shoulder, the upwardly facing shoulder being inwardly beveled, and each of the arcuate contact members has an outwardly extending wing, the wings having a beveled lower surface for substantially flush abutment against the outer housing interior wall upwardly facing shoulder when the inner housing is moving toward the lower position, and for sliding inwardly on such shoulder as said movement continues, said sliding forcing the arcuate contact members against the light bulb threaded base.

In another embodiment the socket further comprises: a negative contact member positioned on the interior wall upwardly facing shoulder; and further wherein: the outer housing has a first end, the outer housing interior wall having a recess, the outer housing having a second end, the second end having a passage from and through the second end to the interior, the passage having a downwardly facing shoulder; the inner housing has a first end, a second end, an outer surface and a generally circular interior, the second end having a passage from and through the second end to the inner housing interior, the outer surface having a hole, the first end having a pair of slots; the retainer member having a head and a retainer member spring, both positioned with the inner housing outer surface hole such that the spring biases the retainer member head out of the hole, the retainer member head being received by the outer perimeter interior wall recess when the inner housing is in the lower position; each of the arcuate contact member wing members is received by one of the inner housing first end slots and moved into contact with the negative contact member as the inner housing is moved to the lower position, and at least one of the wing members is electrically conductive, the at least one conductive wing member contacting the negative contact member when the inner housing is in the lower position; the positive contact member is attached to the biasing member, the biasing member having an electrically conductive shaft with an upwardly facing shoulder and an electrically conductive spring, the shaft being positioned through the outer housing second end passage and through the inner housing second end passage, the spring being positioned in the outer housing second end passage and abutting and biasing the shaft such that the shaft upwardly facing shoulder abuts the outer housing second end passage downwardly facing shoulder when the inner housing is in the upper position, the shaft being slidable through the outer housing second end passage as the threaded base tip is moved against the positive, the spring having a lower end in electrical communication with the electric power source positive; and the device further comprising a first retaining ring for retaining the inner housing within the outer housing; and a second retaining ring for retaining the pair of contact members within the inner housing.

In another embodiment both arcuate contact members are electrically conductive.

In another embodiment each arcuate contact member has an interior side, the interior side having ridges, the ridges being in contact with the light bulb threaded base when the threaded base is inserted within the inner housing.

A socket is provided for receiving a light bulb and electrically powering the bulb using power from an electric power source having a positive and a negative, the light bulb having a threaded base as a negative electrical contact, and a tip as positive electrical contact, the socket comprising: an outer housing and an inner housing within the outer housing, the inner housing being movable from a stationary upper position to a stationary lower position; means for grippingly receiving and contacting the light bulb threaded base when the threaded base is inserted into the inner housing, the contact placing the threaded base in electrical communication with the electric power source negative when the inner housing is in the lower position; a positive contact member and means for placing said positive contact member in electrical communication with the electrical power source positive and in contact with the inserted light bulb tip when the inner housing is in the lower position; means for retaining the inner housing in the lower position, said means releasing the inner housing in response to removal of the threaded base from the inner housing; and means for biasing the inner housing to the upper position member when the retaining member releases the inner housing from the lower position.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
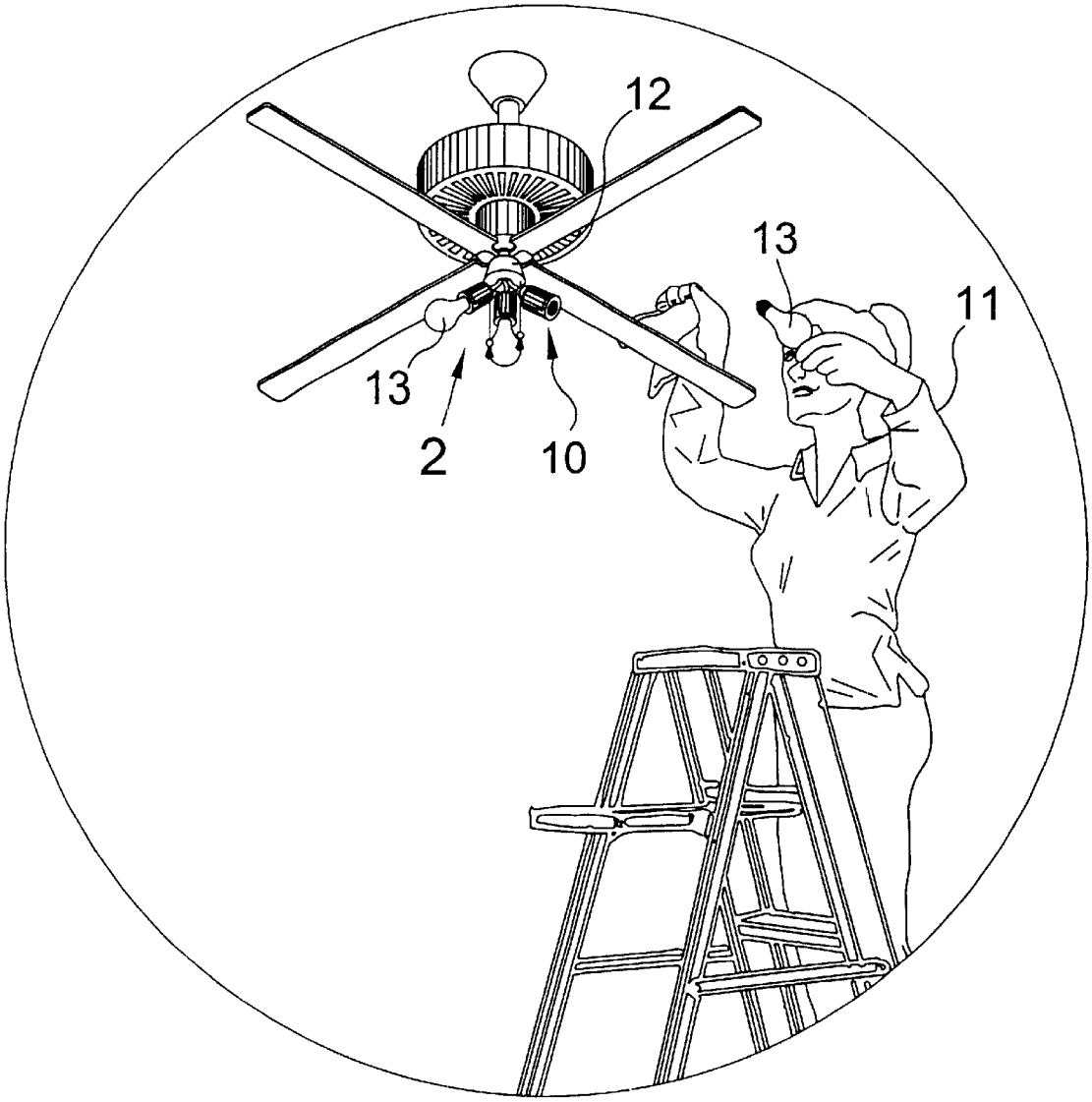
FIG. 1 is a pictorial illustration of the device of the present invention in use. The socket allows a quick and easy installation and removal of a light bulb from the socket of the present invention by pushing a light bulb in to lock and then pulling the light bulb to remove.

Turning now descriptively to the drawings, in which similar reference characters denote similar elements throughout the several views, the figures illustrate exemplary embodiments of the present invention. With regard to the reference numerals used, the following numbering is used throughout the various drawing figures.

10 Exemplary embodiment of the present invention
11 user
12 light fixture
13 light bulb
14 threaded base
15 tip
20 outer housing
22 outer housing interior
24 outer housing interior wall upwardly facing beveled shoulder
26 outer housing first end
28 outer housing notch
30 outer housing notch groove
32 negative contact member
34 wiring
36 bottom negative contact member
38 bottom positive contact member
40 retainer member
42 outer housing passageway
44 first retaining member
46 first retaining member snap
48 first retaining member snap tongue
50 shaft spring
52 outer housing passageway downwardly facing shoulder
60 shaft
62 upwardly facing shaft shoulder
64 shaft upper portion
66 positive contact member
68 inner housing passageway
70 inner housing
72 inner housing notch
73 inner housing notch groove
74 inner housing slot
76 inner housing interior
78 inner housing first end
80 inner housing bottom
82 inner housing outer surface hole
90 retainer member spring
92 retainer member
94 second retaining ring
96 second retaining ring snap
98 second retaining ring snap tongue
100 arcuate contact member
102 arcuate contact member wing
104 ridged arcuate portion
106 arcuate contact member wing beveled lower surface

DETAILED DESCRIPTION OF EXEMPLARY EMBODIMENTS OF THE INVENTION

The following discussion describes in detail exemplary embodiments of the present invention. This discussion should not be construed, however, as limiting the invention to those particular embodiments. Practitioners skilled in the art will recognize numerous other embodiments as well. For a definition of the complete scope of the invention, the reader is directed to the appended claims.

FIG. 1 illustrates the use of the socket 10 provided in an exemplary embodiment of the present invention. The user 11 approaches a light fixture 12 modified by the addition of the socket 10, the user having a light bulb 13 of the type having a threaded base 14 that serves as the negative electrical contact, and a tip 15 that serves as the positive electrical contact. The socket 10 is conventionally connected to an electrical power source that provides a positive and a negative.

Figure 2:
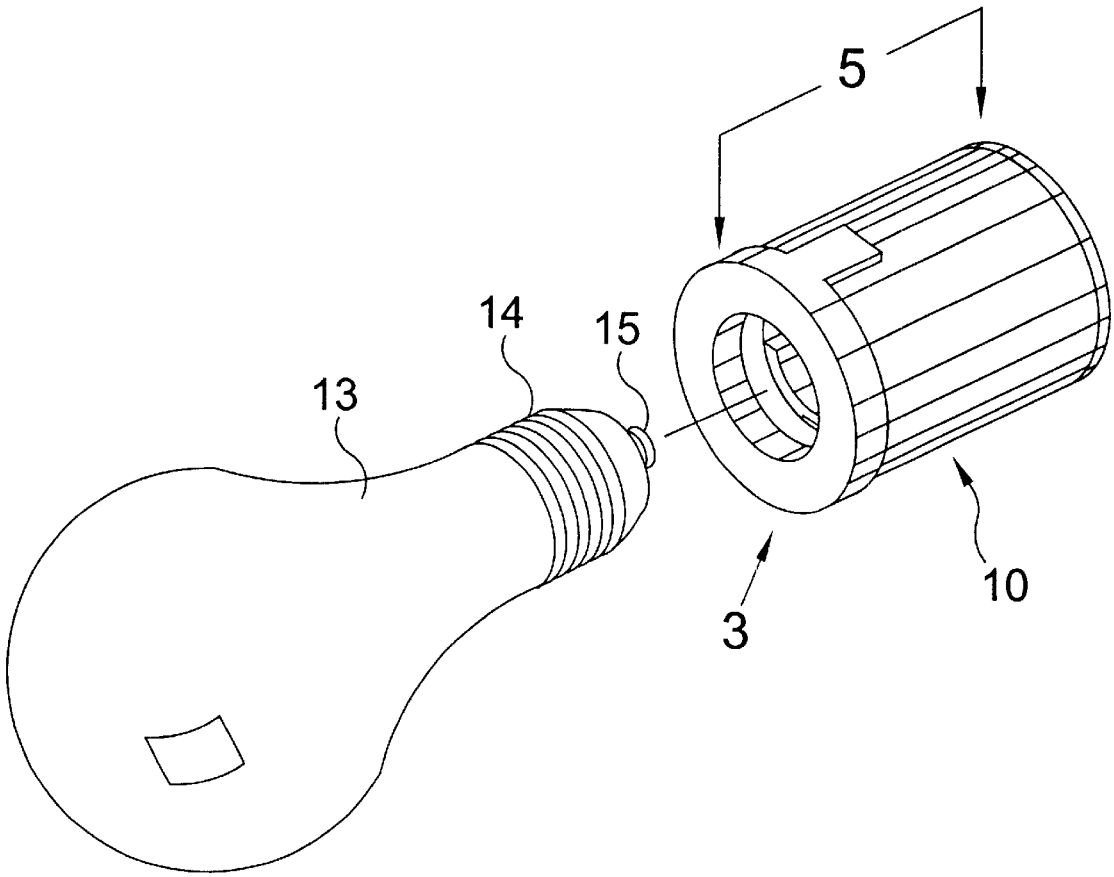
FIG. 2 is a perspective view of the device of the present invention showing the external components that comprise the device and depicting a conventional light bulb about to be inserted into the socket.
Figure 3:
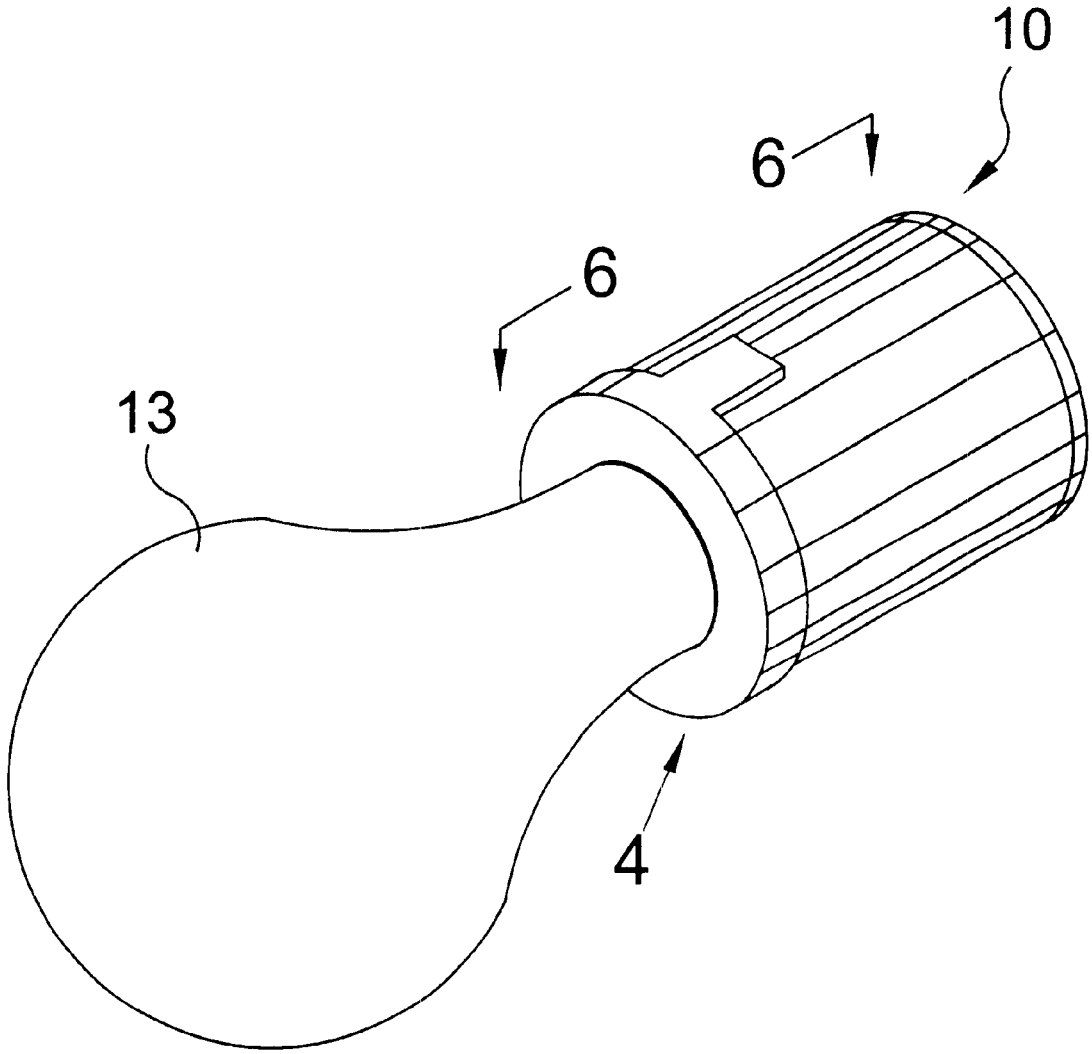
FIG. 3 is a perspective view of the device of the present invention showing the external components that comprise the device and depicting a conventional light bulb inserted into the socket of the present invention.

FIG. 2 illustrates the assembled socket 10 with the light bulb 13 removed, while FIG. 3 illustrates the inserted light bulb. The insertion of the bulb is directly into the socket with no rotation.

Figure 4:
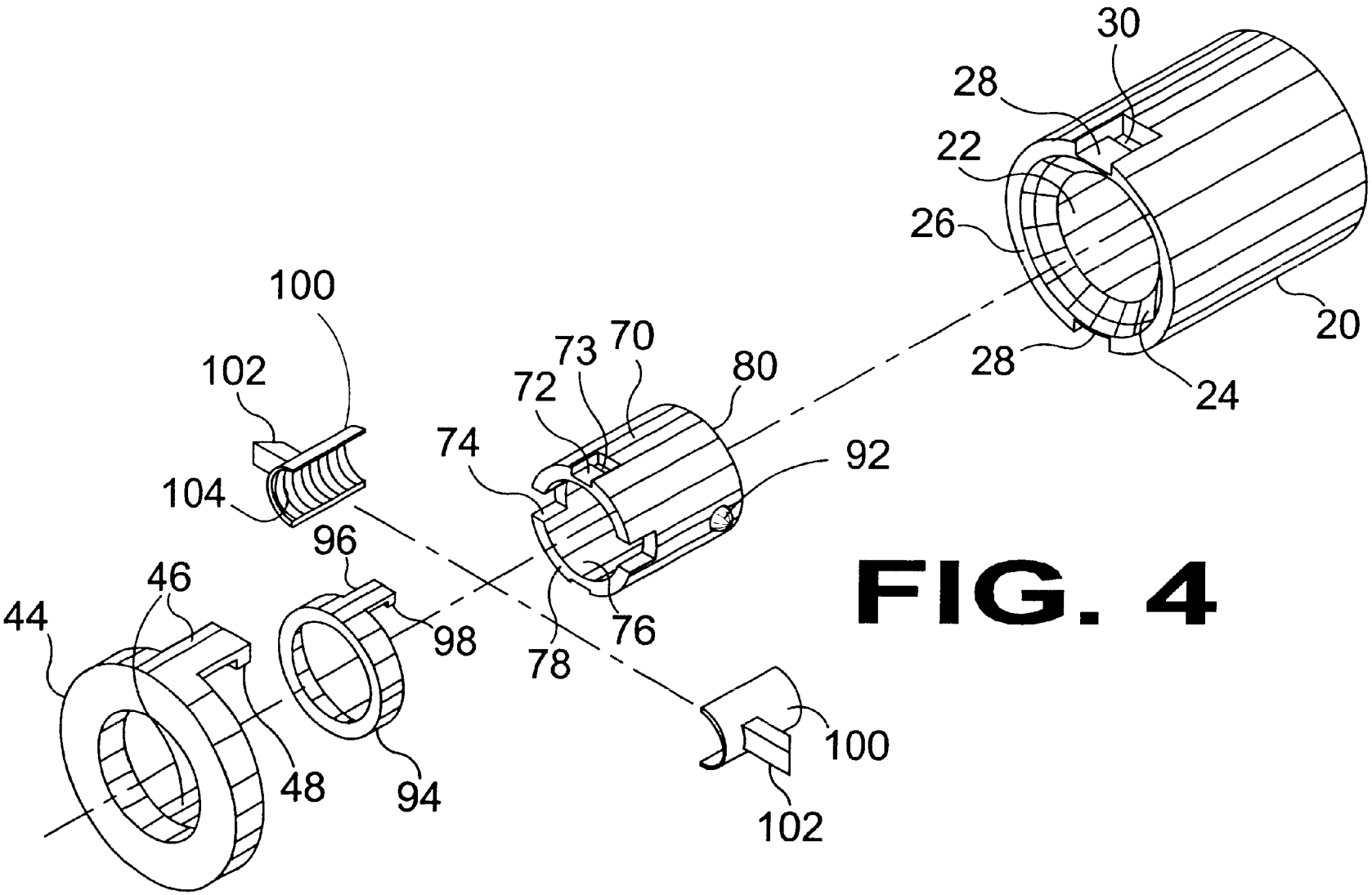
FIG. 4 is an exploded view of an exemplary embodiment of the socket of the present invention.
Figure 5:
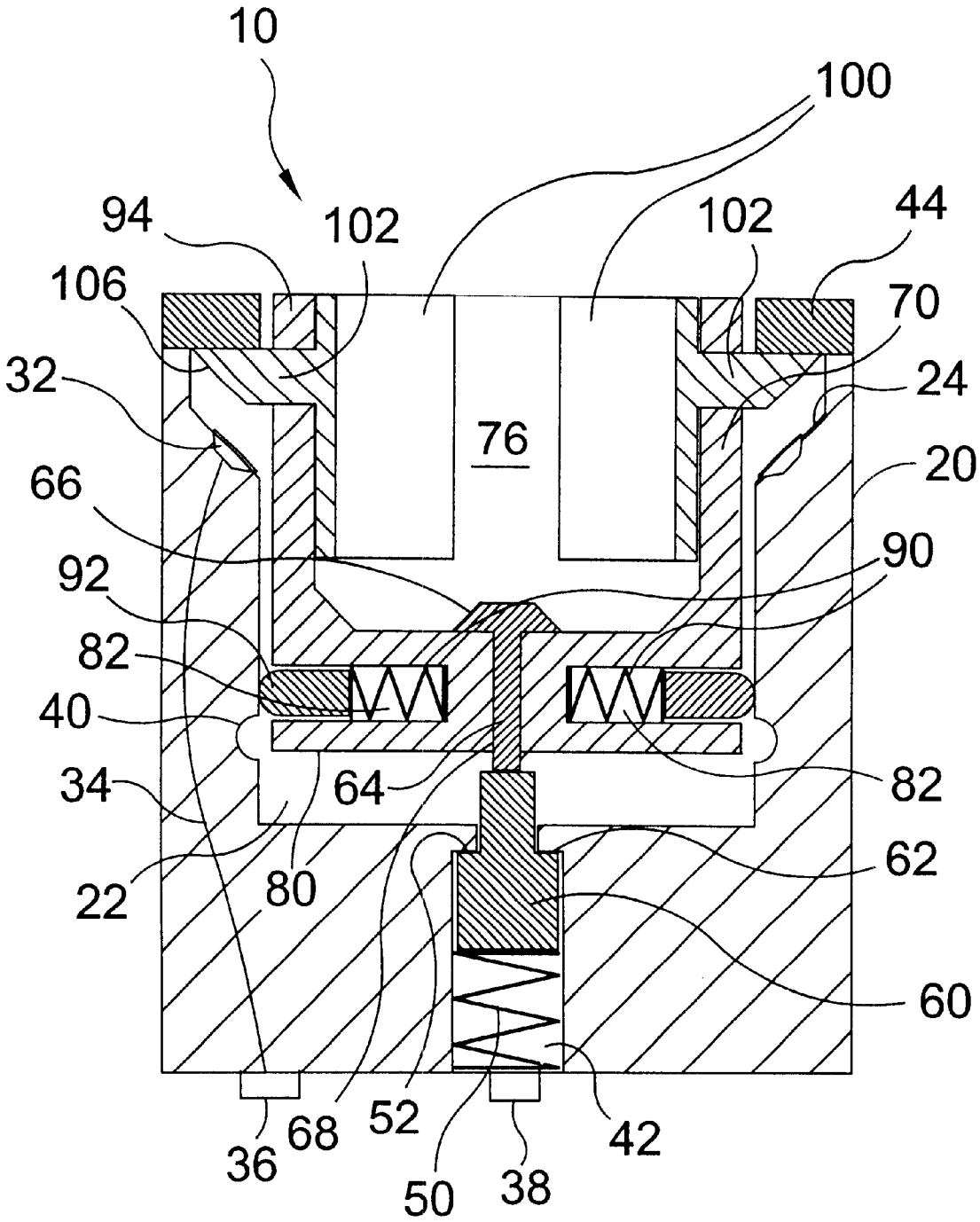
FIG. 5 is a cross section of an exemplary embodiment of the present invention where the inner housing is in the upper position.
Figure 6:
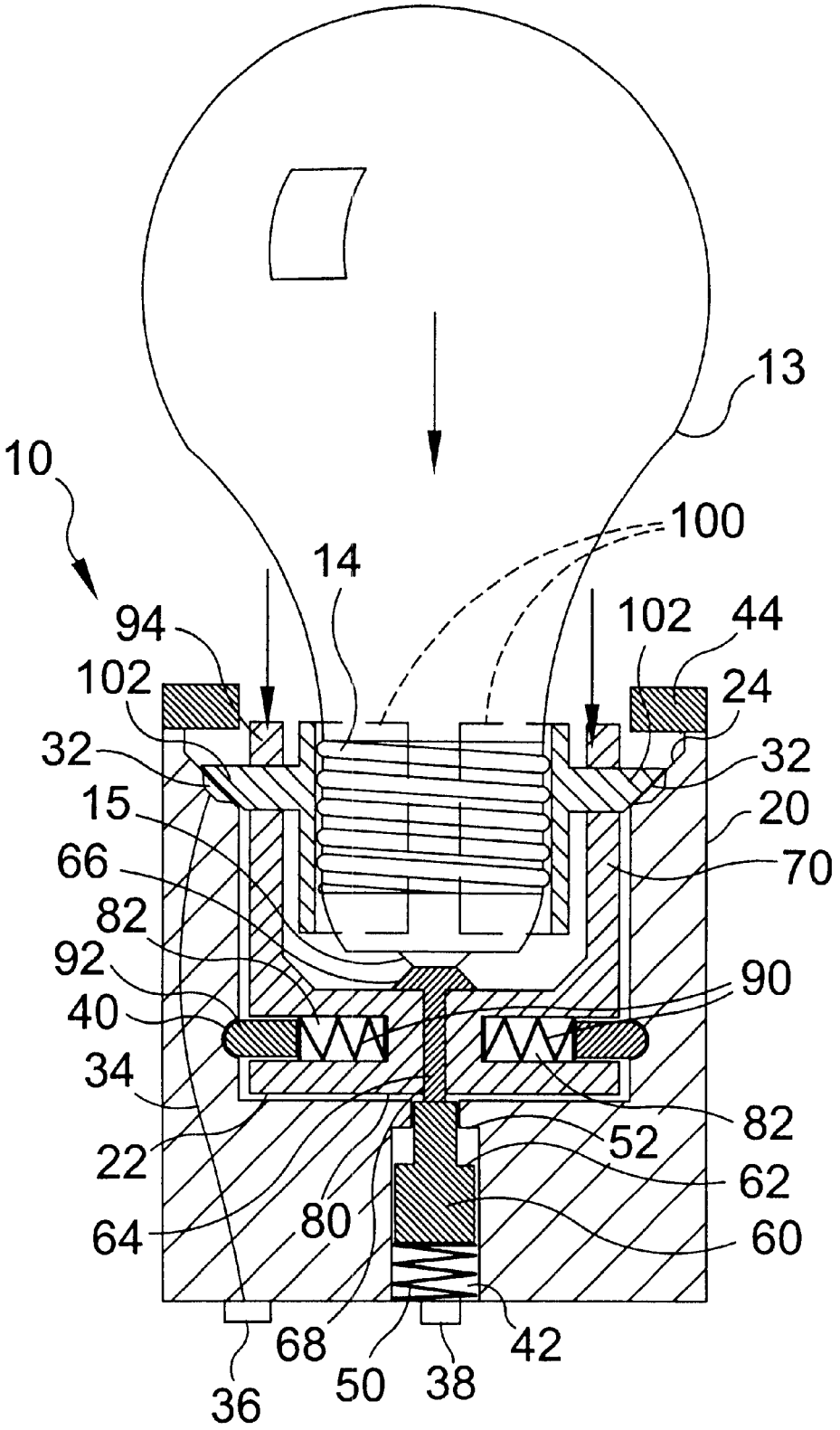
FIG. 6 is a sectional view of an exemplary embodiment of the present invention showing a light bulb inserted into the socket and the inner housing in the lower position.

Turning now to FIGS. 4–6, an exemplary embodiment of the socket 10 is shown to include an outer housing 20, an inner housing 70, two arcuate contact members 100, a shaft 60, a first retaining ring 44 for retaining the inner housing in the outer housing, and a second retaining ring for retaining the arcuate contact members in the inner housing. The outer housing 20 has an interior 22 with an upwardly-facing beveled shoulder 24. The outer housing also has a first end 26 with a pair of opposing notches 28, each notch having a groove 30. When the first retaining ring 44 is positioned against the outer housing first end, the retaining ring 44 has a pair of opposing snaps 46, each with a tongue 48 that is forced into the notch groove 30 as the snap 46 is pushed into the notch 28.

Similarly, the inner housing 70 has a first end 78 and notches 72 with grooves 73. The second retaining ring 94 has opposing snaps 96 with tongues 98, the tongues being forced into the notch grooves 73 as the snaps 96 are pushed into the notches 72.

The outer housing upwardly facing shoulder 24 has a negative contact member 32 running continuously about the perimeter of the outer housing interior 22. The negative contact member 32 is electrically connected to the socket's bottom negative member 36 (shown symbolically in FIG. 5) using conventional wiring 34. The electric power source negative connects to the bottom negative member 36 in conventional fashion such as through wire leads and the like. In some embodiments, the negative contact member 32 on the shoulder 24 is replaced by one or more contacts that do not extend about the perimeter or that extend only partially around the housing interior perimeter.

As shown in FIG. 4, the outer housing 20 has a recess 40 in the interior wall and also has a generally cylindrical passageway 42 extending through the outer housing into the outer housing interior 22. The passageway has a reduced diameter forming a downwardly facing shoulder 52. Blocking the passageway is a bottom positive contact member 38 (shown symbolically in FIG. 5), the electrical power source positive connecting to the bottom positive contact member 38 in conventional fashion such as through wire leads and the like.

By closing the passageway 42 in this manner an electrically conductive spring 50 is restrained so as to upwardly bias an electrically conductive shaft 60 in piston-like fashion. The shaft 60 has a reduced diameter portion for passage through the reduced portion of the passageway 42. The reduction in shaft diameter forms an upwardly facing shaft shoulder 62 that eventually abuts the passageway downwardly facing shoulder 52, thus preventing further upward movement of the shaft 60.

The shaft 60 has an upper portion 64 that continues upwardly, extending through an inner housing passage 68 from the inner housing bottom 80 and into the interior 76 of the interior housing 70. The shaft upper portion 64 terminates in a positive contact member 66 that is centrally positioned in the inner housing interior 76 to align with the light bulb tip 15 when the bulb threaded base 14 is inserted into the inner housing. The inner housing 70 moves with the positive contact member 66 and shaft upper portion 64.

The inner housing 70 also has a pair of generally rectangular slots 74 that align with the arcuate contact member outwardly extending wings 102, such that the wings 102 protrude from the inner housing 70. The wings have a downwardly facing beveled surface 106 that generally conforms to the outer housing interior wall upwardly facing beveled shoulder 24, as shown in FIG. 6.

As the light bulb threaded base 14 is inserted into the inner housing 70 it is partially encompassed by the ridged arcuate portion 104 of the arcuate contact members 100. When the light bulb tip 15 abuts the positive contact member 66 the shaft 60 is pushed against the spring 50 causing the inner housing assembly to move from an upper position to a lower position.

As the inner housing 70 moves downwardly the wings' beveled surfaces 106 encounter the outer housing interior upwardly facing beveled shoulder 24 and the wings 102 are forced to slide along the plane of encounter. This forces the arcuate contact members 100 against the bulb threaded base 14. The pressure is sufficient to secure the bulb 13 and is supplemented by the frictional resistance to movement provided by the ridges on the arcuate portions 104.

Furthermore, as the wings 102 descend, their beveled lower surface 106 contacts the negative contact member 32 on the housing interior wall upwardly facing shoulder 24. The arcuate members 100 are electrically conductive, thus electrical communication with the light bulb threaded base 14 is established by such contact. In some embodiments only one of the arcuate members is electrically conductive.

As illustrated in FIG. 6, the inner housing 70 is retained in the lower position, with the light bulb 13 firmly secured, by retainer members 92. Each retainer member 92 is positioned in an inner housing outer surface hole 82 along with a spring 90 that biases the retainer member 92 toward the outer housing interior 22. Each retainer member has a rounded head that is received by the outer housing interior wall recess 40, the spring 90 biasing the retainer member to stay in the recess 40. This retains the inner housing 70 in the lower position. In some embodiments only one retainer member and spring assembly is provided.

Due to the non-cylindrical retainer member head, however, a firm pull on the light bulb 13, using a force typically associated with handling glass light bulbs, will overcome the spring 90 bias and the retainer member 92 can be pulled from the recess 40. This allows the shaft spring 50 to again move the inner housing 70 to the upper position, as shown in FIG. 5. The upward motion removes the force on the wings 102 such that the squeeze applied to the threaded base 14 by the arcuate contact members 100 is released and the light bulb 14 can be freely removed from the inner housing.

With respect to the above description then, it is to be realized that the optimum material and dimensional relationships for the parts of the socket 10, will include variations in size, materials, shape, and form, which will occur to those skilled in the art upon review of the present disclosure. For example the conductive portions of the socket are constructed from various metals or plastics with continuous metallic elements therein. Non-conductive portions are constructed from various woods, plastics and glasses.

All equivalent relationships to those illustrated in the drawings and described in the specification are intended to be encompassed by the present invention.

What is claimed as new and desired to be protected by Letters Patent is set forth in the appended claims:

1. A socket for receiving a light bulb and electrically powering the bulb using power from an electric power source having a positive and a negative, the light bulb having a threaded base as a negative electrical contact, and a tip as positive electrical contact, the socket comprising:

an outer housing, an inner housing within the outer housing, and a pair of arcuate contact members within the inner housing, the inner housing being movable from a stationary upper position to a stationary lower position, the arcuate contact members at least partially encompassing and contacting the light bulb threaded base when the threaded base is inserted into the inner housing, at least one of the contact members being in electrical communication with the electric power source negative when the inner housing is in the lower position;

a positive contact member in electrical communication with the electrical power source positive, the positive contact member being positioned in the inner housing for contact with the inserted light bulb tip when the inner housing is in the lower position;

a retaining member for retaining the inner housing in the lower position, the retaining member releasing the inner housing in response to removal of the threaded base from the inner housing; and a biasing member for biasing the inner housing to the upper position member when the retaining member releases the inner housing from the lower position;

and further wherein the outer housing comprises an interior, the interior forming an interior wall, the interior wall having an upwardly facing shoulder, the upwardly facing shoulder being inwardly beveled, and each of the arcuate contact members has an outwardly extending wing, the wings having a beveled lower surface for substantially flush abutment against the outer housing interior wall upwardly facing shoulder when the inner housing is moving toward the lower position, and for sliding inwardly on such shoulder as said movement continues, said sliding forcing the arcuate contact members against the light bulb threaded base.

2. The socket of claim 1 further comprising:

a negative contact member positioned on the interior wall upwardly facing shoulder;

and further wherein:

the outer housing has a first end, the outer housing interior wall having a recess, the outer housing having a second end, the second end having a passage from and through the second end to the interior, the passage having a downwardly facing shoulder;

the inner housing has a first end, a second end, an outer surface and a generally circular interior, the second end having a passage from and through the second end to the inner housing interior, the outer surface having a hole, the first end having a pair of slots;

the retainer member having a head and a retainer member spring, both positioned with the inner housing outer surface hole such that the spring biases the retainer member head out of the hole, the retainer member head being received by the outer perimeter interior wall recess when the inner housing is in the lower position;

each of the arcuate contact member wing members is received by one of the inner housing first end slots and moved into contact with the negative contact member as the inner housing is moved to the lower position, and at least one of the wing members is electrically conductive, the at least one conductive wing member contacting the negative contact member when the inner housing is in the lower position;

the positive contact member is attached to the biasing member, the biasing member having an electrically conductive shaft with an upwardly facing shoulder and an electrically conductive spring, the shaft being positioned through the outer housing second end passage and through the inner housing second end passage, the spring being positioned in the outer housing second end passage and abutting and biasing the shaft such that the shaft upwardly facing shoulder abuts the outer housing second end passage downwardly facing shoulder when the inner housing is in the upper position, the shaft being slidable through the outer housing second end passage as the threaded base tip is moved against the positive, the spring having a lower end in electrical communication with the electric power source positive; and the device further comprising a first retaining ring for retaining the inner housing within the outer housing; and a second retaining ring for retaining the pair of contact members within the inner housing.

3. The socket of claim 1, wherein both arcuate contact members are electrically conductive.

4. The socket of claim 1, wherein each arcuate contact member has an interior side, the interior side having ridges, the ridges being in contact with the light bulb threaded base when the threaded base is inserted within the inner housing.

5. A socket for receiving a light bulb and electrically powering the bulb using power from an electric power source having a positive and a negative, the light bulb having a threaded base as a negative electrical contact, and a tip as positive electrical contact, the socket comprising:

an outer housing and an inner housing within the outer housing, the inner housing being movable from a stationary upper position to a stationary lower position;

means for grippingly receiving and contacting the light bulb threaded base when the threaded base is inserted into the inner housing, the contact placing the threaded base in electrical communication with the electric power source negative when the inner housing is in the lower position;

a positive contact member and means for placing said positive contact member in electrical communication with the electrical power source positive and in contact with the inserted light bulb tip when the inner housing is in the lower position;

means for retaining the inner housing in the lower position, said means releasing the inner housing in response to removal of the threaded base from the inner housing; and means for biasing the inner housing to the upper position member when the retaining member releases the inner housing from the lower position.

* * * * *